US007661988B1

(12) United States Patent
He et al.

(10) Patent No.: US 7,661,988 B1
(45) Date of Patent: Feb. 16, 2010

(54) CARD CONNECTOR

(75) Inventors: Hang-Xiao He, Tu-Cheng (TW); Wei-Hong Liao, Tu-Cheng (TW); Ming-Chiang Chen, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/292,297

(22) Filed: Nov. 17, 2008

(51) Int. Cl.
*H01R 13/648* (2006.01)

(52) U.S. Cl. ..... 439/607.32

(58) Field of Classification Search ..... 439/607.32, 439/607.31, 607.33, 607.22, 630, 495
See application file for complete search history.

(56) References Cited

U.S. PATENT DOCUMENTS 5,017,156 A * 5/1991 Sugiyama ..... 439/607.32
5,073,130 A * 12/1991 Nakamura ..... 439/607.32
5,288,247 A * 2/1994 Kaufman ..... 439/607.33
5,470,259 A * 11/1995 Kaufman et al. ..... 439/607.33
5,478,260 A * 12/1995 Kaufman et al. ..... 439/607.31
6,129,562 A * 10/2000 Hong ..... 439/79
6,247,968 B1 * 6/2001 Wu ..... 439/607.22
6,390,850 B2 * 5/2002 Yoshimura et al. ..... 439/607.22
6,629,860 B1 * 10/2003 Hu et al. ..... 439/607.31
6,685,509 B1 * 2/2004 Yeh ..... 439/607.22
6,736,676 B2 * 5/2004 Zhang et al. ..... 439/607.22
6,821,149 B2 * 11/2004 Lai ..... 439/607.31
6,866,530 B1 * 3/2005 Yen-Lin ..... 439/326
6,899,565 B2 * 5/2005 Kodera et al. ..... 439/607.22
6,994,591 B2 * 2/2006 Huang ..... 439/607.36
7,134,912 B2 * 11/2006 Kamata et al. ..... 439/607.31
2003/0036309 A1 * 2/2003 Zhang et al. ..... 439/607

* cited by examiner

*Primary Examiner*—T C Patel
*Assistant Examiner*—Vladimir Imas
(74) *Attorney, Agent, or Firm*—Rosenberg, Klein & Lee

(57) ABSTRACT

A card connector adapted for accommodating a memory card includes a dielectric housing, a plurality of terminals received in the dielectric housing, and a shell. The dielectric housing defines a plurality of terminal grooves for receiving the terminals. The shell shielding the dielectric housing has a top board and two sideboards extending downward from two opposite sides of the top board. The junction of the top board and at least one of the two sideboards is depressed inward to form a connecting board of substantially L-shaped cross-section. The top board, the two sideboards and the connecting board of the shell and the dielectric housing define a space therebetween for receiving the memory card therein.

4 Claims, 7 Drawing Sheets

CARD CONNECTOR

BACKGROUND OF THE INVENTION

1. Field of the Invention

The present invention relates to a connector, and more particularly to a card connector.

2. The Related Art

Please refer to FIG. 1, a conventional card connector includes a dielectric housing 10', a plurality of conductive terminals 30' received in the dielectric housing 10' and a shield 20' covering the dielectric housing 10'. The dielectric housing 10' has a base 11' which defines a plurality of terminal grooves 111' therein for receiving the conductive terminals 20'. Two ends of an upper surface of the base 11' respectively extend upward to form a sidewall 12'. An upper end of each of the sidewall 12' is bent inward to form a top board 13'. The shield 20' has a main board 21' and two sideboards 22' extending downward from two opposite sides of the main board 21'. When the card connector is assembled, the main board 21' of the shield 20' and the base 11', the sidewalls 12', and the top board 13' of the dielectric housing 10' define a cavity for receiving a memory card (not shown). The card connector can prevent the memory card from being inserted into the card connector reversely because of the shape of the cavity.

However, the sidewalls 12' and the top board 13' used for avoiding the reverse insertion increase the width of the dielectric housing 10'. Moreover, the width of the shield 20' is also increased corresponding to the dielectric housing 10'. So the card connector not only has a relative bigger size, but also wastes materials.

SUMMARY OF THE INVENTION

An object of the present invention is to provide a card connector which has a relative smaller size. The card connector adapted for accommodating a memory card includes a dielectric housing, a plurality of terminals received in the dielectric housing, and a shell. The dielectric housing defines a plurality of terminal grooves for receiving the terminals. The shell shielding the dielectric housing has a top board and two sideboards extending downward from two opposite sides of the top board. The junction of the top board and at least one of the two sideboards is depressed inward to form a connecting board of substantially L-shaped cross-section. The top board, the two sideboards and the connecting board of the shell and the dielectric housing define a space therebetween for receiving the memory card therein.

The top board, the L-shaped connecting board, the sideboards and the dielectric housing define the space for receiving the memory card, and due to the particular shape of the space, the card connector can prevent the memory card from reverse insertion. The width of the card connector according to the present invention can be decreased. It is beneficial for the miniaturization of the card connector.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
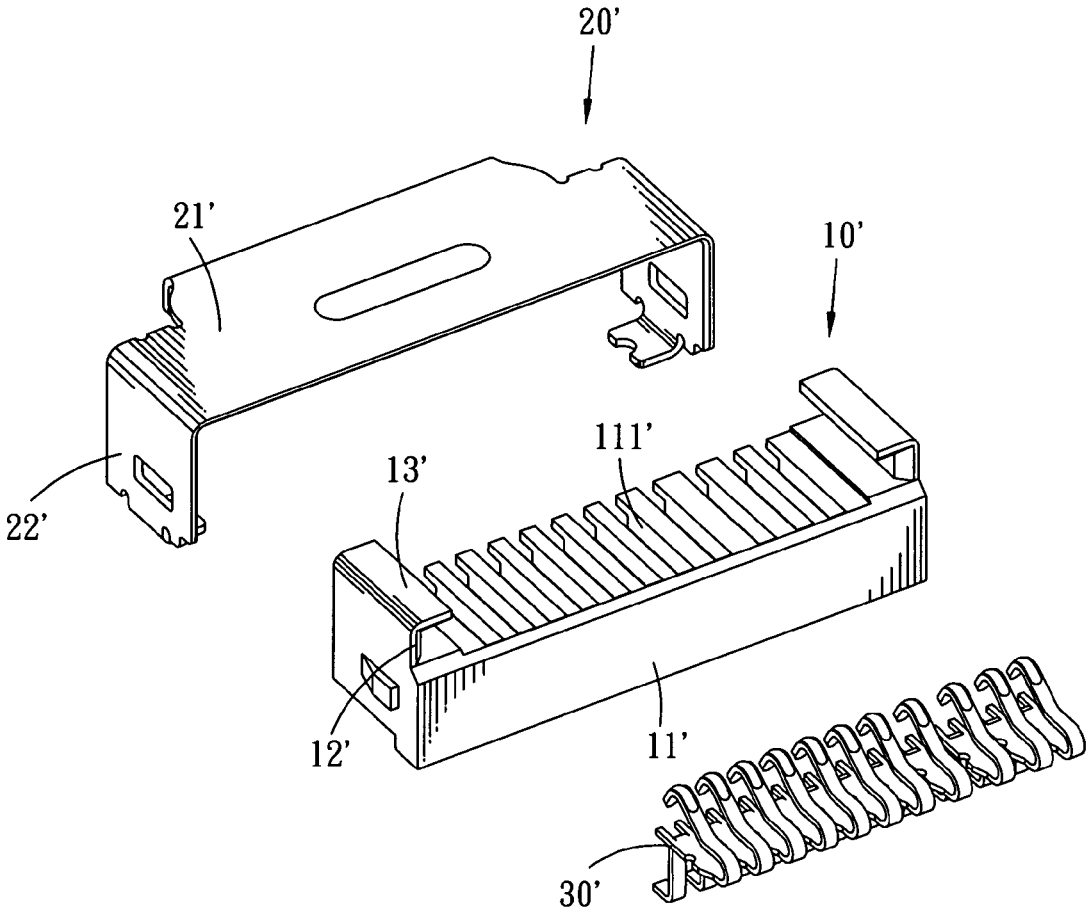
FIG. 1 (Prior Art)
FIG. 1 is a perspective view of a conventional card connector.
Figure 2:
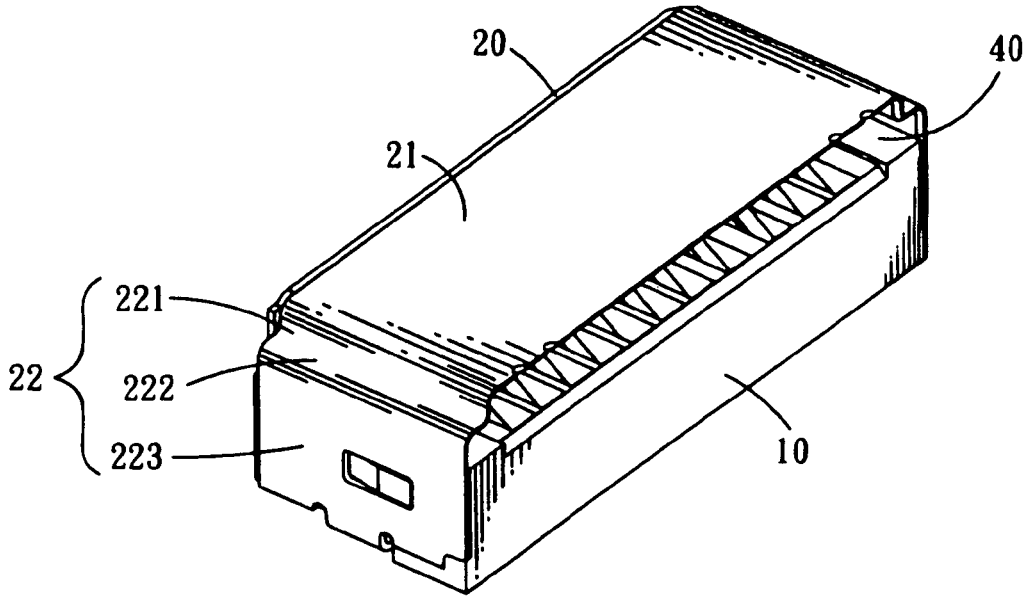
FIG. 2 is a perspective view of a card connector according to the present invention.
Figure 3:
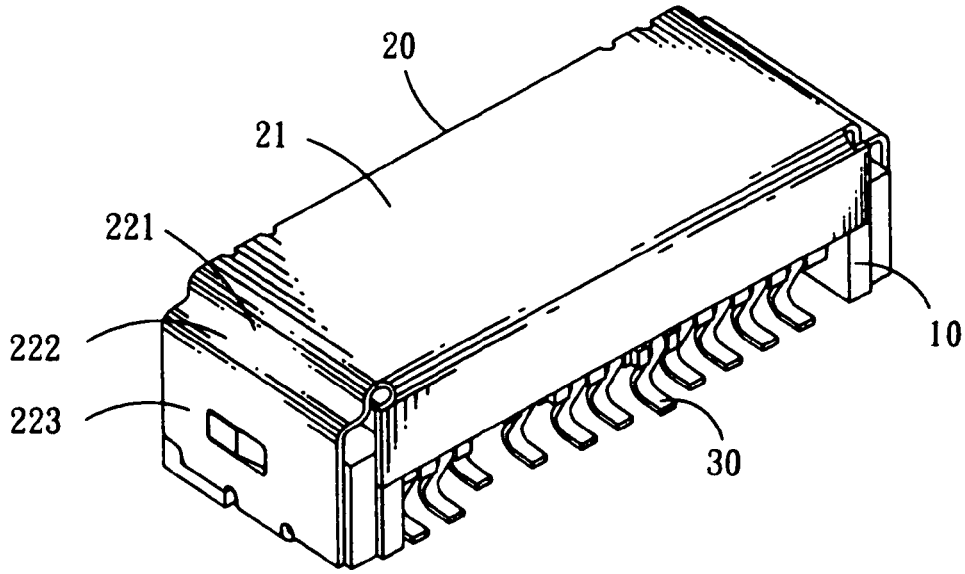
FIG. 3 is another perspective view of the card connector shown in FIG. 2.

With reference to FIG. 2 and FIG. 3, a card connector according to the present invention includes a dielectric housing 10, a plurality of conductive terminals 30 mounted in the dielectric housing 10, a shell 20 shielding the dielectric housing 10.

With reference to FIGS. 4-7, the dielectric housing 10 has a substantially rectangular base 11. A plurality of terminal grooves 111 is formed in the base 11. Each of the terminal grooves 111 includes a main groove 1111 passing through a front surface and a top surface of the base 11. Front ends of two opposite inner surfaces of the main groove 1111 respectively protrude inward to form a first protrusion 1112. A lower portion of the front end of each first protrusion 1112 is recessed to form a first slot 1113 communicating with the main groove 1111. The rear end of each first protrusion 1112 protrudes inward to form a second protrusion 1114. A lower portion of the front end of the second protrusion 1114 is recessed to form a second slot 1115 communicating with the main groove 1111. Two ends of the front surface of the base 11 respectively protrude forward to form a lump 12. Two bumps 13 are respectively protruded outward from a middle portion of two opposite sidewalls of the base 11.

Figure 4:
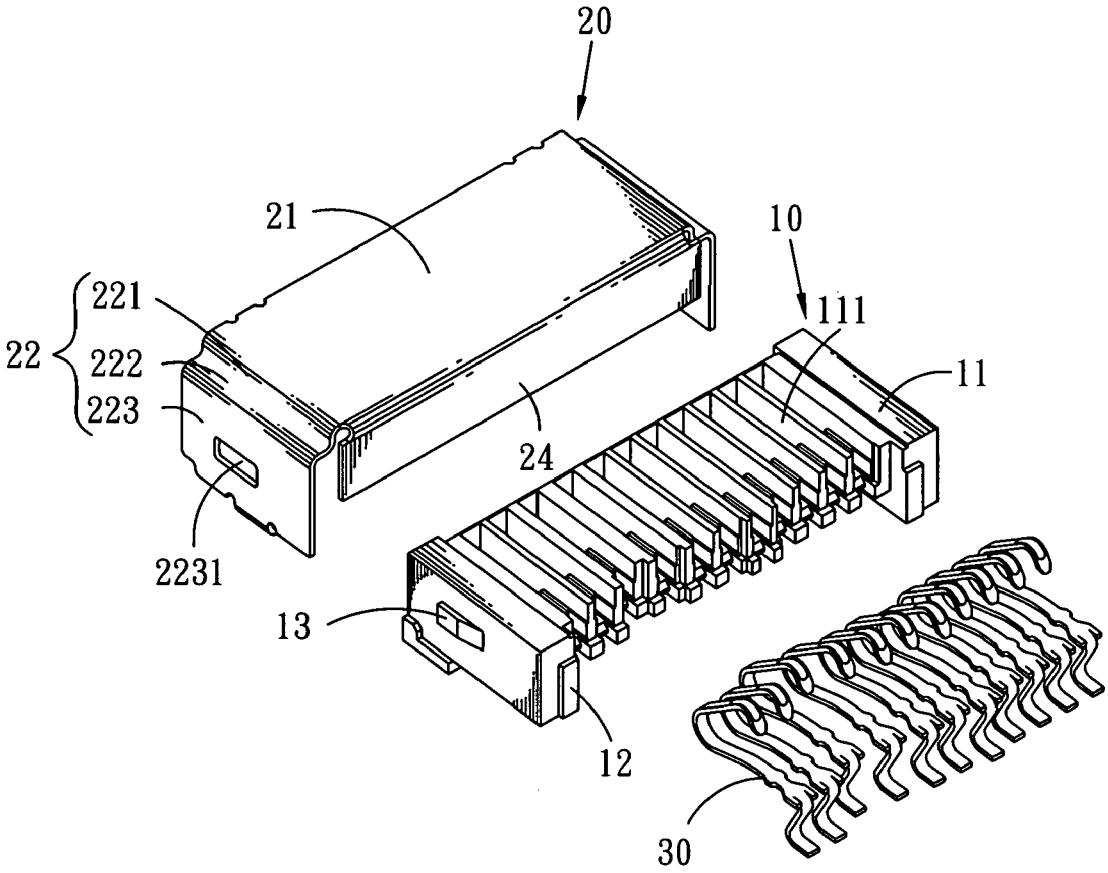
FIG. 4 is an exploded view of the card connector shown in FIG. 2.

Referring to FIG. 4 and FIG. 5 again, the shell 20 shielding the dielectric housing 10 has a top board 21, two sideboards 23 extending downward from two opposite sides of the top board 21. The two junctions of the top board 21 and the two sideboards 23 are respectively depressed inward to form a connecting board 22 of substantially L-shaped cross-section. Each of the connecting boards 22 includes a first connecting portion 221 perpendicularly bending downward from one side of the top board 21 and a second connecting portion 222 perpendicularly bending outward from a bottom side of the first connecting portion 221. An aperture 231 is formed in a middle portion of each sideboard 23. A tab 24 perpendicularly extends inward from a middle portion of the bottom side of each sideboard 23. A front side of the top board 21 extends downward to form a front board 25.

Figure 5:
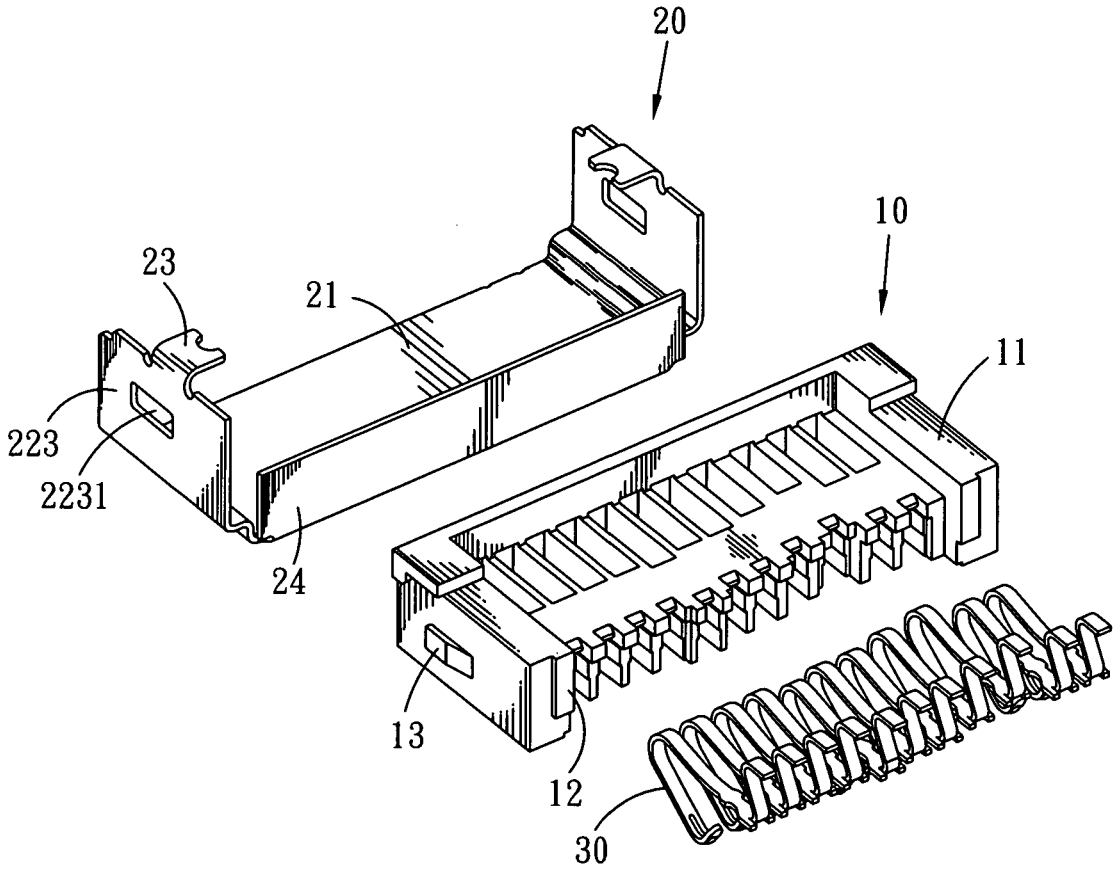
FIG. 5 is another exploded view of the card connector shown in FIG. 2.
Figure 6:
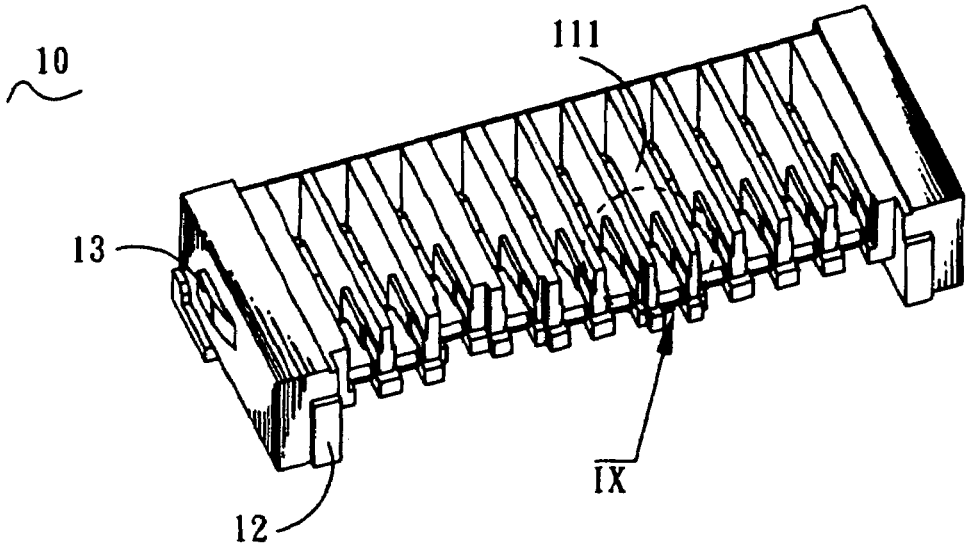
FIG. 6 is a perspective view of a dielectric housing of the card connector shown in FIG. 4.
Figure 7:
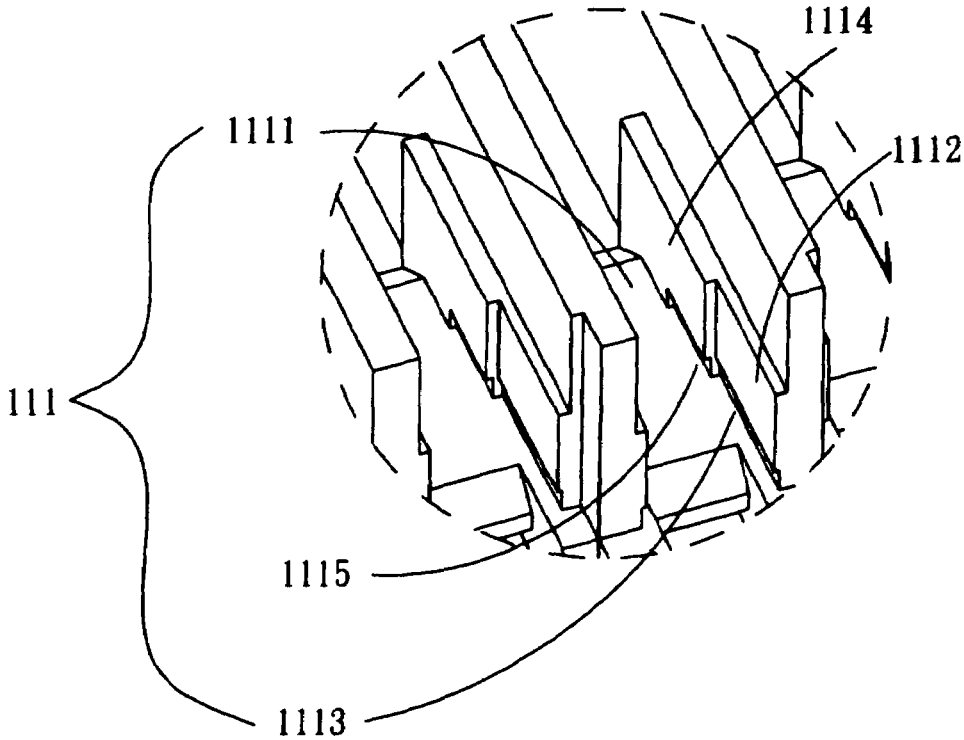
FIG. 7 is an enlarged view of a part IX shown in FIG. 6.
Figure 8:
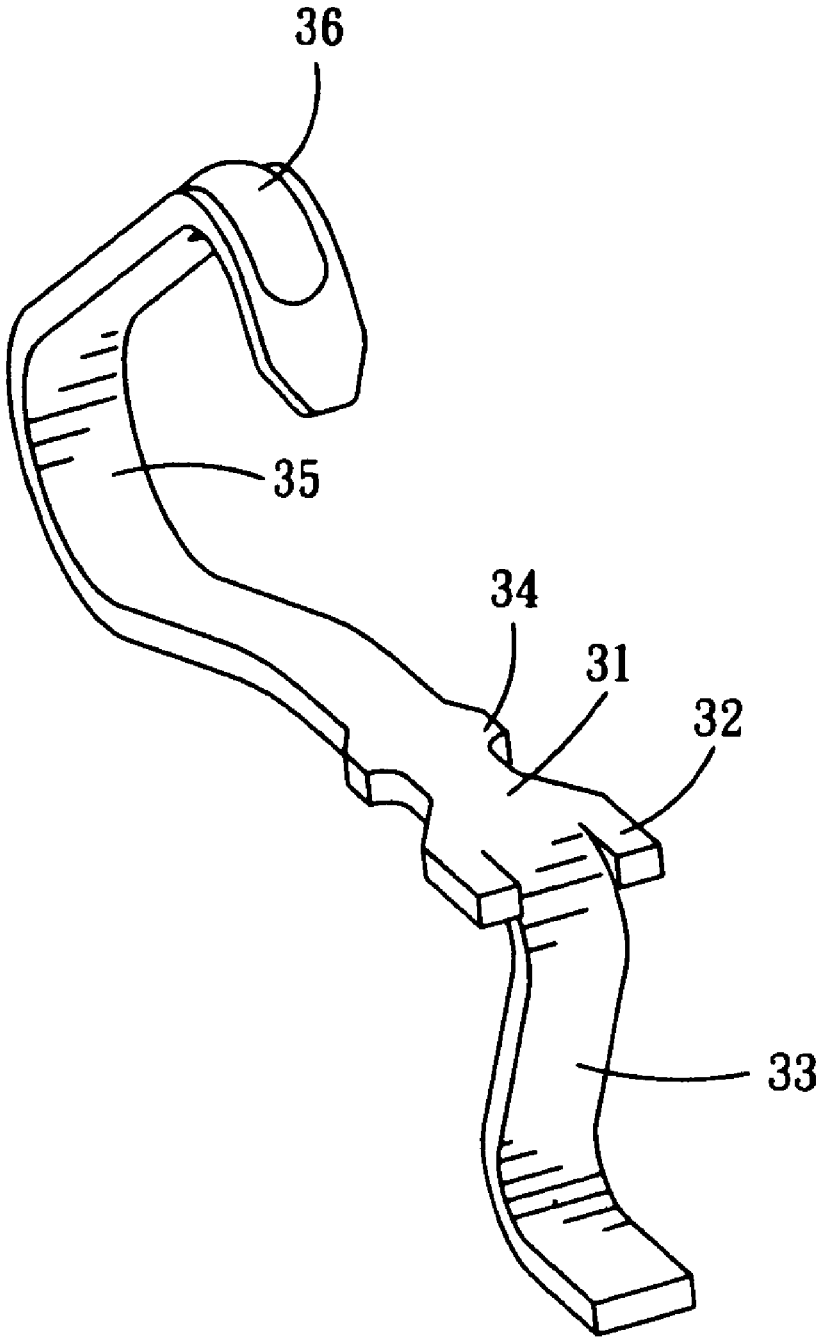
FIG. 8 is a perspective view of a conductive terminal of the card connector in FIG. 4.
Figure 9:
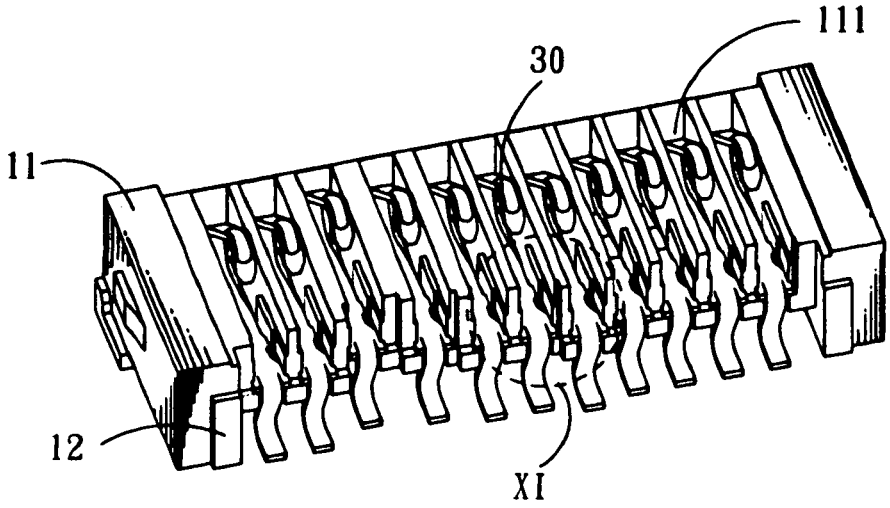
FIG. 9 is a perspective view of the dielectric housing assembled with the conductive terminals of the card connector shown in FIG. 4.
Figure 10:
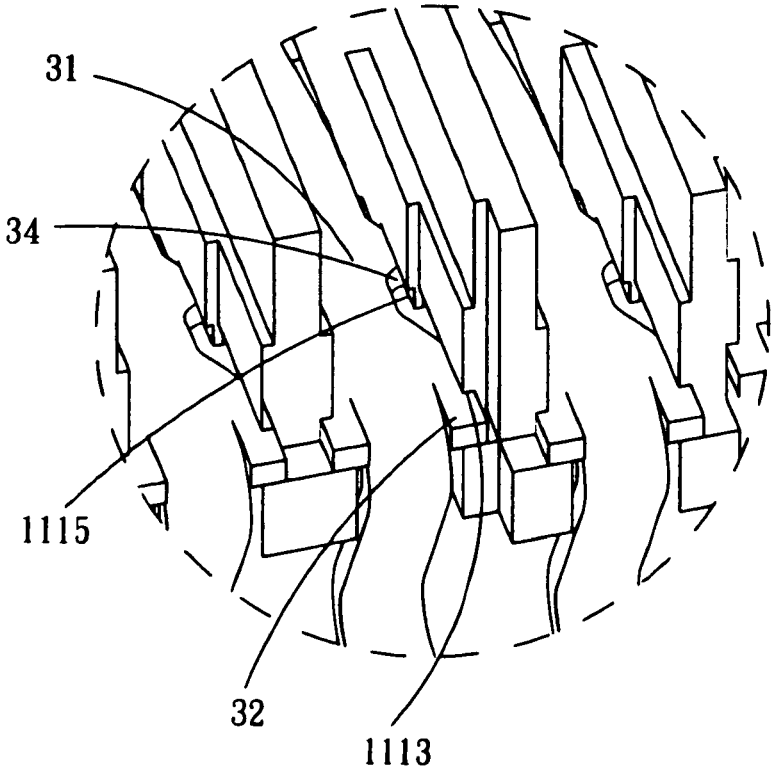
FIG. 10 is an enlarged view of a part XI shown in FIG. 9.

Please refer to FIGS. 4, 5 and 8, each of the conductive terminals 30 includes a basic board 31. Two sides of a front end of the basic board 31 extend forward to form two first projections 32. A soldering portion 33 bends from the front end of the basic board 31 between the two first projections 32. Two sides of a middle portion of the basic board 31 extend outward to form two second projections 34. A rear end of the basic board 31 extends rearward and then bends upward to form a bending portion 35. A free end of the bending portion 35 slantwise extends forward and upward and then bends downward to form a contact portion 36.

Please refer to FIGS. 6, 7, 9 and 10, when the card connector is in assembly, the conductive terminals 30 are received in the corresponding terminal grooves 111. More specially, the basic board 31, the bending portion 35 and the contact portion 36 are received in the main groove 1111, the first projections 32 and the second projections 34 are respectively fixed in the first slots 1113 and the second slots 1115, and the soldering portion 33 extends out of the terminal grooves 111 from the front end of the terminal grooves 111.

Please refer to FIGS. 2, 3, 4 and 5, after the conductive terminals 30 are mounted in the dielectric housing 10, the shell 20 covers the dielectric housing 10. More specially, the two bumps 1-3 respectively engage with the two apertures 231 to ensure the shell 20 on the dielectric housing 10. The two tabs 24 are restricted on a bottom surface of the dielectric housing 10. A bottom side of the front board 25 is supported on an upper end of each of the lumps 12. In this case, a space 40 is formed between the top board 21, the two sideboards 23 and the connecting boards 22 of the shell 20 and the dielectric housing 10 for receiving a M2 card (Memory Stick Micro Card) therein. Because the distance between the two first connecting portions 221 is smaller than that between the two second connecting portions 222, the particular shape of the space 40 prevents the M2 card from reverse insertion.

As described above, the top board 21, the two sideboards 23 and the connecting boards 22 of the shell 20 and the dielectric housing 10 define the space 40 for receiving the memory card, and due to the particular shape of the space 40, the card connector can prevent the memory card from reverse insertion. Compare with the prior art which defines two sidewalls in the dielectric housing, the card connector according to the present invention can decrease the width of the two sidewalls, which is beneficial for the miniaturization of the card connector. Moreover, the card connector can save materials and decrease the cost due to the decrease of the width.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A card connector adapted for accommodating a memory card, comprising:

a dielectric housing defining a plurality of terminal grooves therein;

a plurality of terminals received in the corresponding terminal grooves of the dielectric housing; and a shell shielding the dielectric housing, the shell having a top board and two sideboards extending downward from two opposite sides of the top board, the junction of the top board and at least one of the two sideboards being depressed inward to form a connecting board of substantially L-shaped cross-section, wherein the top board, the two sideboards and the connecting board of the shell and the dielectric housing define a space therebetween for receiving the memory card therein, each of the terminal grooves including a main groove, two opposite inner surfaces of the main groove respectively protrude inward to form a first protrusion, a first slot is formed in the first protrusion, each of the terminals includes a basic board, two sides of one end of the basic board extend forward to form two first projections, the first projections are respectively fixed in the first slots.

2. The card connector as claimed in claim 1, wherein the junctions of the top board and the two sideboards are respectively depressed inward to form two connecting board of substantially L-shaped cross-section.

3. The card connector as claimed in claim 1, wherein the rear end of each first protrusion protrudes inward to form a second protrusion, a second slot is formed in the second protrusion, two sides of the basic board extend outward to form two second projections, the second projections are respectively fixed in the second slots.

4. The card connector as claimed in claim 1, wherein the shell has a front board extending downward from a front end of the top board, at least one lump protrudes from a front surface of the dielectric housing, the free end of the front board is supported on an upper end of the lump when the dielectric housing is shielded by the shell.

* * * * *